US006219432B1

(12) United States Patent
Fryer et al.

(10) Patent No.: US 6,219,432 B1
(45) Date of Patent: Apr. 17, 2001

(54) LOUDSPEAKER DRIVE UNIT

(75) Inventors: Peter Alexander Fryer, W. Sussex; Stuart Michael Nevill, Kent; Stephen Philip Barnham Roe, Sussex, all of (GB)

(73) Assignee: B&W Loudspeakers Limited, Worthing (GB)

( * ) Notice: Subject to any disclaimer, the term of this patent is extended or adjusted under 35 U.S.C. 154(b) by 0 days.

(21) Appl. No.: 09/214,623

(22) PCT Filed: Jul. 2, 1997

(86) PCT No.: PCT/GB97/01773

§ 371 Date: Jan. 11, 1999

§ 102(e) Date: Jan. 11, 1999

(87) PCT Pub. No.: WO98/02016

PCT Pub. Date: Jan. 15, 1998

(30) Foreign Application Priority Data

Jul. 9, 1996 (GB) ..... 9614395
Apr. 30, 1997 (GB) ..... 9708874

(51) Int. Cl.[7] ..... H04R 25/00

(52) U.S. Cl. ..... 381/398; 381/423; 181/171

(58) Field of Search ..... 381/398, 405, 381/184, 423, 428, 432, FOR 153; 181/164, 169, 171, 172; 367/174, 163

(56) References Cited

U.S. PATENT DOCUMENTS

| | | | | |
|---|---|---|---|---|
| 3,684,052 | | 8/1972 | Sotome . | |
| 3,862,376 | | 1/1975 | White . | |
| 4,433,214 | | 2/1984 | Jasinski . | |
| 4,517,416 | * | 5/1985 | Goossens | 381/428 |
| 4,547,631 | | 10/1985 | Nieuwendijk et al. . | |
| 4,821,330 | * | 4/1989 | Pfleiderer | 381/184 |
| 5,608,810 | * | 3/1997 | Hall | 381/398 |

FOREIGN PATENT DOCUMENTS

| | | | | |
|---|---|---|---|---|
| 0 492 914 A2 | | 7/1992 | (EP) . | |
| 885501 | | 12/1961 | (GB) . | |
| 1 270 033 | | 4/1972 | (GB) . | |
| 1491080 | | 11/1977 | (GB) . | |
| 1 563 511 | | 3/1980 | (GB) . | |
| 1604934 | | 12/1981 | (GB) . | |
| 2087688 | | 5/1982 | (GB) . | |
| 2 122 453 | | 1/1984 | (GB) . | |
| 2 153 629 | | 8/1985 | (GB) . | |
| 2 182 823 | | 5/1987 | (GB) . | |
| 59-94996 | | 5/1984 | (JP) . | |
| 59-108500 | | 6/1984 | (JP) . | |
| 60-192497 | | 9/1985 | (JP) . | |
| 61-195100 | | 8/1986 | (JP) . | |
| 5-161193 | | 6/1993 | (JP) . | |
| 406165291 | * | 6/1994 | (JP) | 381/FOR 153 |
| 7-015791 | | 1/1995 | (JP) . | |
| 7-222280 | | 8/1995 | (JP) . | |
| WO 83/01884 | | 5/1983 | (WO) . | |

OTHER PUBLICATIONS

M Colloms, "High Performance Loudspeakers", 4$^{th}$ edition, published 1991, Pentech Press, pp. 166–168.

* cited by examiner

*Primary Examiner*—Curtis Kuntz
*Assistant Examiner*—Suhan Ni
(74) *Attorney, Agent, or Firm*—Burns, Doane, Swecker & Mathis, L.L.P.

(57) ABSTRACT

A loudspeaker drive unit (1) comprises a diaphragm (2), a chassis member (3) and a surround (4) connecting the outer portion of the diaphragm to the chassis member in which (i) substantially all parts of the surround (4) located between the diaphragm (2) and the chassis member (3) and capable of radiating sound are arranged parallel or at an acute angle with respect to the longitudinal axis of the loudspeaker drive unit (1), or (ii) the surround is made of a body of foam material (30) arranged to be compressed against the chassis member (32) when the diaphragm (10) moves towards the chassis member, or (iii) the bending wave impedance of the surround (30) is matched to the bending wave impedance of the diaphragm (10).

22 Claims, 3 Drawing Sheets

LOUDSPEAKER DRIVE UNIT

BACKGROUND OF THE INVENTION

1. Field of the Invention

This invention relates to loudspeaker drive units.

2. Description of Related Art

Known loudspeaker drive units comprise a diaphragm of which the outer portion is connected to a chassis member by way of a flexible surround.

The surround stops sound radiated by the rear surface of the diaphragm from passing round the outer edge of the diaphragm and thus cancelling out radiation from the front surface of the diaphragm. The surround allows the cone to move freely in an axial direction but restrains movement of a rocking kind or in a non-axial direction.

The surround thus has an important role in the operation of a loudspeaker drive unit, particularly, if the drive unit is to be used in a hi fi audio system.

In fact, both the surround and the diaphragm influence the quality of sound reproduction from a loudspeaker drive unit and it is exceedingly difficult to come close to an "ideal" loudspeaker drive unit using currently available materials.

OBJECTS AND SUMMARY

It is an object of the invention to provide a loudspeaker drive unit with an improved surround.

In one aspect thereof, the present invention provides a loudspeaker drive unit comprising:

a diaphragm made of a first material;

a chassis member: and a surround made of a second, different, material connecting the outer portion of the diaphragm to the chassis member; wherein the bending wave impedance of the surround is substantially equal to the bending wave impedance of the diaphragm.

The surround provides mechanical damping to waves of bending that travel up the diaphragm and enter the surround and it reduces the possibility that these waves will be reflected back down into the diaphragm again. This first aspect of the invention is based on the realisation that when the bending wave impedance of the diaphragm is substantially equal to the bending wave impedance of the surround, the matching of the two impedances can avoid the reflection of waves back into the diaphragm again because the diaphragm is correctly "terminated".

The characteristic impedance of a medium is the velocity of the type of wave in question multiplied by the density of the medium. For a bending wave the velocity is given by the following formula:

$$(1.8f*h)\hat{}0.5(e/ro)\hat{}0.25$$

where ro=density, e=Young's modulus, h=thickness and f=frequency.

If, for the sake of example, the thickness of the surround was equal to the thickness of the diaphragm but the density of the surround was ⅛ the density of the diaphragm, and the Young's modulus of the surround was ⅛ the Young's modulus of the diaphragm, then the bending wave velocity would be the same in both the surround and the diaphragm but the bending wave impedance of the surround would be ⅛ that of the diaphragm. If the thickness of the surround were now made instead 8*8 (=64) times the thickness of the diaphragm, matching of the bending wave impedances would be achieved.

When bending waves are reflected back into a diaphragm, standing waves tend to appear and the diaphragm seems to "break up" into sections instead of acting uniformly. This "break up" can be avoided by matching the bending wave impedance of the surround to that of the diaphragm.

According to another aspect thereof, the present invention provides a loudspeaker drive unit comprising:

a diaphragm;

a chassis member: and a surround connecting the outer portion of the diaphragm to the chassis member; wherein the surround is made of a body of foam material arranged to be compressed against the chassis member when the diaphragm moves towards the chassis member.

In such a construction, axial movement of the diaphragm alternately compresses and decompresses the material of the surround rather than bending it as in a conventional surround.

The use of a surround made of a body of foam material arranged to be compressed against the chassis member when the diaphragm moves towards the chassis member provides a particularly effective and practical solution to avoiding sound radiation from the surround and one which lends itself particularly well to matching of the bending wave impedances as in the first-mentioned aspect of the invention.

Preferably, substantially all parts of the surround located between the diaphragm and the chassis member and capable of radiating sound are arranged parallel or at an acute angle with respect to the longitudinal axis of the loudspeaker drive unit.

This aspect of the invention is based on the realization that the surround has its own resonant frequencies and that by arranging that substantially all parts of the surround located between the diaphragm and the chassis member and capable of radiating sound are arranged parallel or at an acute angle with respect to the longitudinal axis of the loudspeaker drive unit the adverse effect of these resonances can be reduced. In such an arrangement sound is not radiated forwards from the surround with the sound from the diaphragm but is directed away to the side or at an angle. The effect of resonances of the surround is therefore less objectionable to a listener positioned in front of the loudspeaker drive unit.

The invention may be applied to either an active loudspeaker drive unit, that is, for example, one with a magnet system and voice coil for driving the diaphragm, or to a passive radiator, that is, a unit in which there is no direct electromagnetic drive to the diaphragm. Passive radiators, sometimes called "drone cones" are used in ports of loudspeaker enclosures.

Preferably, the outer portion of the diaphragm lies axially beyond the chassis member. The diaphragm then lies closest to the listener and the surround is located behind it.

The surround may be joined to the diaphragm at a location spaced from the periphery of the diaphragm. Such a construction enables the diaphragm to be made larger than the surround.

Advantageously, the surround is of integral construction with the diaphragm. By that means problems of making a connection between the surround and the diaphragm can be avoided.

The surround may be made of a resilient polymeric material, for example, rubber, for example, silicone rubber. A surround made of such material has particularly good flexibility.

The surround may be made of a foam material, for example, foam plastics material or foam rubber material. A surround made of such a material has particularly good damping properties.

The surround may be made of plastics material.

The surround may be made of a woven material.

Advantageously, the surround is corrugated. That is a simple way of giving the diaphragm freedom to move.

The surround may be substantially "C"-shaped in cross-section and preferably the open mouth of the "C" faces the said axis.

The surround may be substantially ">"-shaped in cross-section and preferably the point of the ">" faces the said axis. Such a construction comprises in effect two straight sections joined by an integral hinge portion.

The surround may be of square cross-section, two opposite sides of the square running substantially parallel to the said axis and the two remaining sides being joined to the diaphragm and chassis member respectively. Such a construction is particularly simple to realize using foam material. The surround may be rectangular instead of square in cross-section.

The surround may be in the form of bellows running substantially parallel to the said axis.

The surround may be in the form of a ring, preferably a ring of hollow cross-section.

The ring may be of circular cross-section or of elliptical cross-section.

The interior of the ring when of hollow form may be sealed and optionally the interior of such a ring is filled with a gas, for example, air. Optionally, the gas is under pressure. Such constructions provide a cushioning effect somewhat analogously to the inner tube of a bicycle tire.

The interior of a hollow ring may instead be open to ambient air by way of slits or holes.

Preferably, the diaphragm is cone-shaped and the periphery of the cone is joined to the flange by a re-entrant portion. Such a construction is particularly well-suited to matching of the bending wave impedances.

The re-entrant portion simply makes an annular indentation in the foam material when it compresses it towards the chassis member.

Preferably, the re-entrant portion makes a circumferential line contact with the body of foam material. Such a construction ensures that very little of the foam material is put into motion by the diaphragm.

The foam material may extend radially further outwardly of the line contact than it does radially inwardly thereof. By that means it is possible to provide a good mounting for the re-entrant portion and to ensure that there is sufficient foam to dissipate the energy of bending waves entering it from the diaphragm.

Preferably, the re-entrant portion is an integrally-formed part of the diaphragm.

Preferably, the diaphragm is made of a resin-impregnated woven plastics material.

As in the first aspect of the invention, the bending wave impedance of the surround is preferably substantially equal to the bending wave impedance of the diaphragm.

The use of the material and dimensions specified in the next five paragraphs, particularly in combination, enables an exceptionally good loudspeaker drive unit, with virtually no "break up" owing to the reflection of bending waves, to be produced.

The plastics material may be Kevlar.

Preferably, the foam material has a Shore hardness in the range 20 to 30.

The diaphragm may have a diameter in the range 100 to 180 centimetres.

Preferably, the thickness of the diaphragm is in the range 0.5 to 1.0 millimeters inclusive.

The thickness of the body of foam material may in the range 2 to 10 millimeters inclusive, preferably in the range 3 to 6 millimeters inclusive.

BRIEF DESCRIPTION OF THE DRAWINGS

Loudspeaker drive units constructed in accordance with the invention will now be described, by way of example only, with reference to the accompanying drawing, in which.

DETAILED DESCRIPTION OF THE PREFERRED EMBODIMENTS

Figure 1:
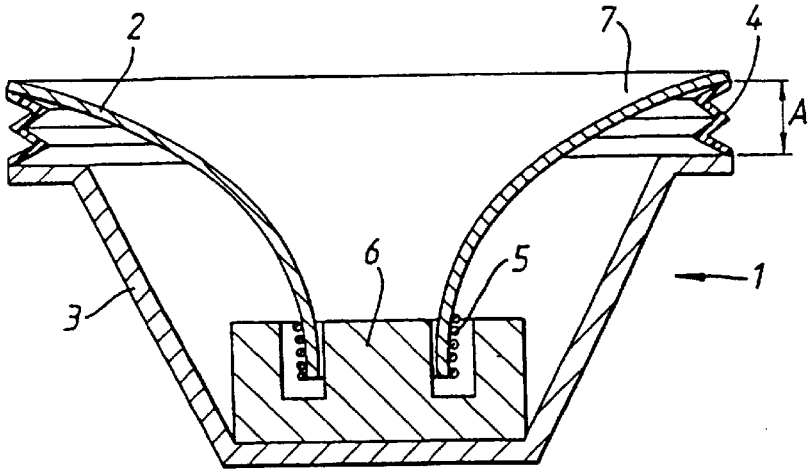
FIG. 1 is a diagrammatic cross-section through a first loudspeaker drive unit in accordance with the invention.

Referring to the accompanying drawings, a loudspeaker drive unit 1 is shown in FIG. 1 and comprises a diaphragm 2, a chassis member 3 and a corrugated surround 4. The diaphragm 2 is a cone-type diaphragm and is provided with a voice coil 5 located in an annular gap of a magnet system 6. The central portion of the diaphragm 2 is supported by a so-called "spider" not shown in the figure. The outer portion 7 of the diaphragm lies axially beyond the chassis member 3 by the spacing A.

The surround 4 is in the form of cylindrical bellows running parallel to the central axis of the drive unit 1 and thus effectively all parts of the surround located between the diaphragm 2 and the chassis member 3 and capable of radiating sound are arranged at an acute angle or parallel with respect to the longitudinal axis of the loudspeaker drive unit.

The cylindrical bellows surround 4 is made of any suitable material, for example, plastics, silicone rubber or woven material.

Figure 2:
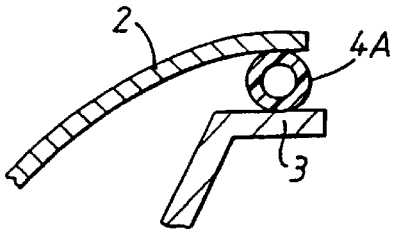
FIGS. 2 to 5 show diagrammatically modifications to the drive unit of FIG. 1.

FIG. 2 shows an arrangement in which the bellows surround 4 is replaced by a surround 4A in the form of a ring of hollow circular cross-section. The interior of the ring 4A is sealed and filled with air under pressure.

Figure 3:
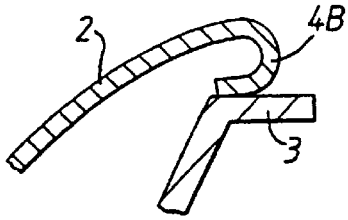

FIG. 3 shows an arrangement in which the bellows surround 4 is replaced by a surround 4B of integral construction with the diaphragm 2. The surround 4B is substantially "C"-shaped in cross-section and the open mouth of the "C" faces the central axis of the drive unit 1.

Figure 4:
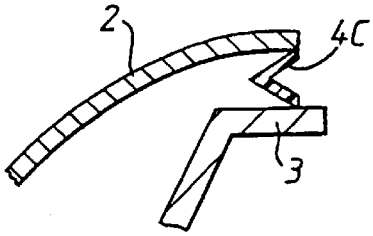

FIG. 4 shows an arrangement in which the bellows surround 4 is replaced by a surround 4C that is ">"-shaped (or "V" on its side) in cross-section, the point of the ">" facing the said axis.

Figure 5:
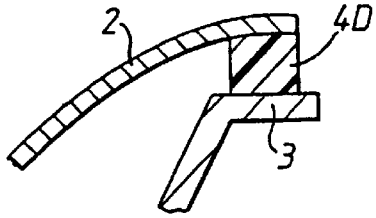

FIG. 5 shows an arrangement in which the bellows surround 4 is replaced by a surround 4D of square cross-section, two opposite sides of the square running substantially parallel to the said axis and the two remaining sides being joined to the diaphragm 2 and chassis member 3 respectively. The surround 4D is made of a foam plastics material.

Figure 6:
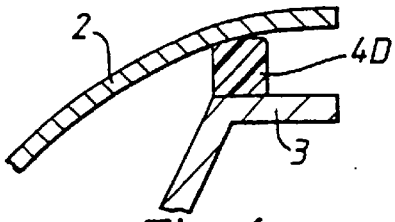
FIG. 6 shows a further modification applied to the drive unit of FIG. 5.

FIG. 6 shows a modification to the arrangement of FIG. 5 in which the surround 4D is joined to the diaphragm 2 at a location spaced from the periphery of the diaphragm. This variation may be applied to the surrounds shown in any of FIGS. 1 to 4.

Figure 7:
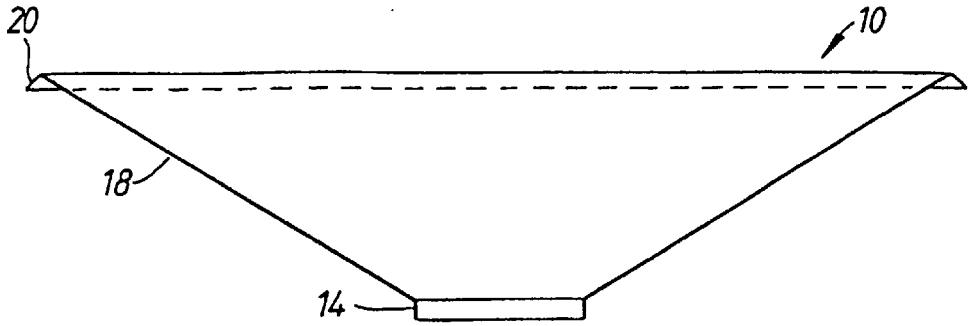
FIG. 7 is a diagrammatic cross-sectional representation of the diaphragm of a second loudspeaker drive unit embodying the invention shown in FIG. 10.
Figure 10:
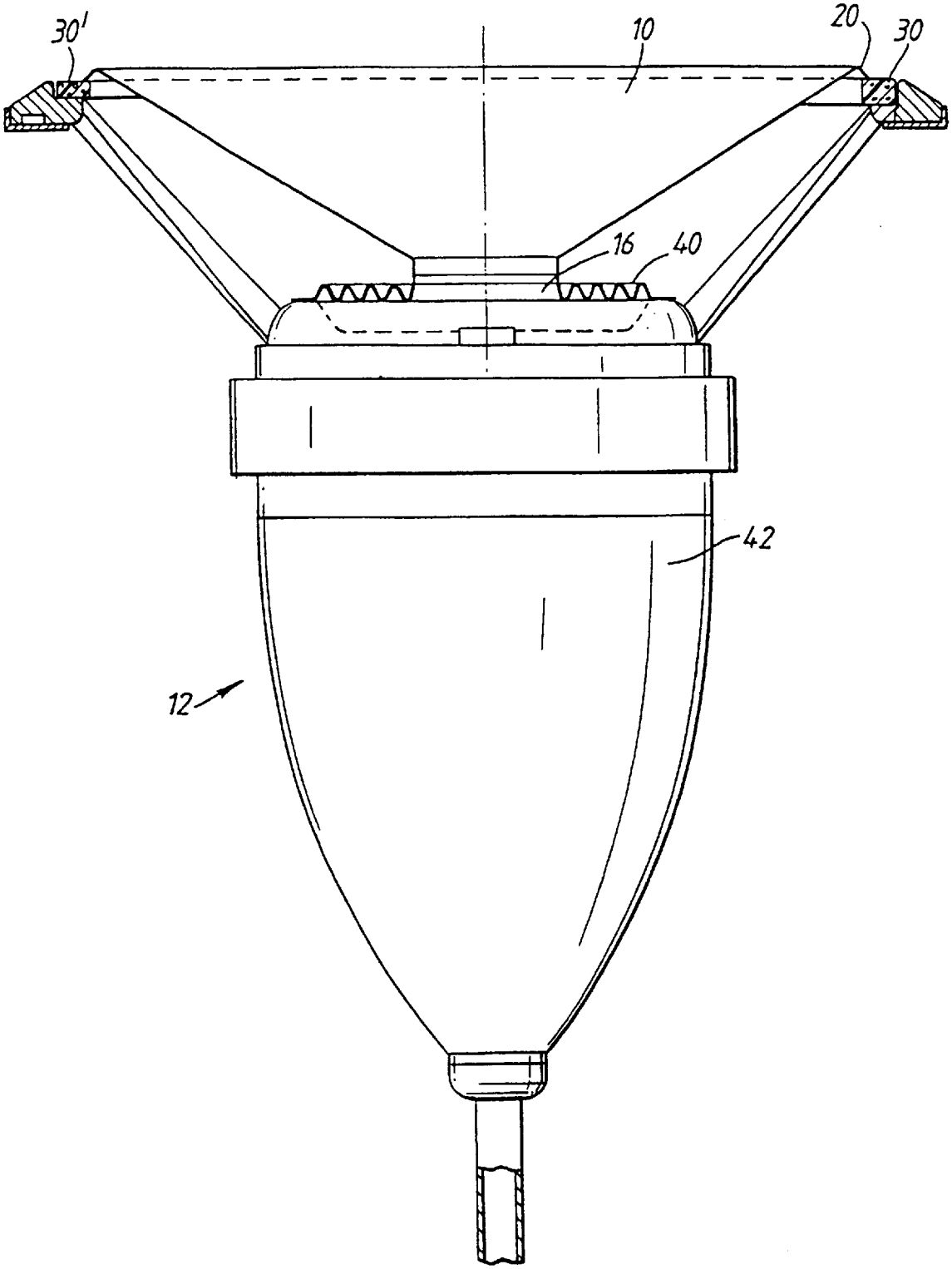
FIG. 10 is a diagrammatic, partly sectional view, of the second loudspeaker drive unit, the right hand side of the figure corresponding to FIG. 9 and the left hand side corresponding to FIG. 10.

FIG. 7 shows the diaphragm 10 of the loudspeaker drive unit 12 shown in FIG. 10. The diaphragm 10 is made of resin-impregnated woven Kevlar (registered Trade Mark) which is a polyaramide made by Dupont. Suitable discs of resin-impregnated woven Kevlar are available from Messrs Fothergill and Harvey (also known as Cautaults) under the reference D)208/030/9022. Such discs have a weight before resin application of 20 grams per meter and a solvent to resin ratio of 3:2 is used. The resin-impregnated woven Kevlar discs are pressed into the cone-shape shown in the figure and heat treated to harden the resin and lock the cone into shape.

The diaphragm 10 comprises a throat portion 14 for attachment to the voice coil 16 (FIG. 10), a cone portion 18 of 120° conical flare, and a re-entrant portion 20. The overall diameter of the diaphragm 10 is approximately 140 millimeters.

Figure 8:
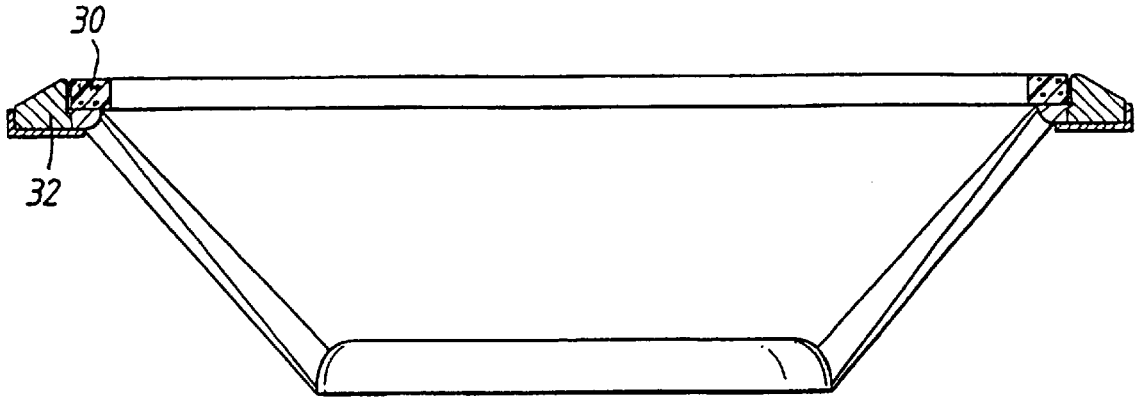
FIGS. 8 and 9 are diagrammatic cross-sectional representations of alternative surrounds for the drive unit of FIG. 10.
Figure 9:
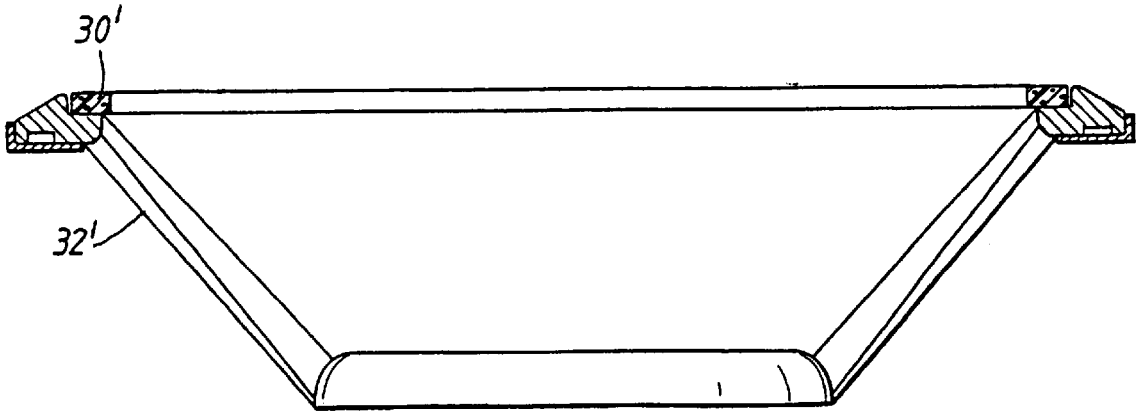

The periphery diaphragm 10 is mounted in the loudspeaker drive unit 12 by either the surround 30 and chassis member 32 shown in FIG. 8 or the surround 30' and chassis member 32' shown in FIG. 9. In FIG. 10, the right hand side of the figure shows the use of the arrangement of FIG. 8 and the left hand side that of FIG. 9.

The surrounds 30 and 30' each comprise an annulus made out of foam material of rectangular section. The foam material used is a low density, very soft foam PVC with a strong acrylic pressure-sensitive adhesive on each of two opposite sides sold, under the trade name Techniseal 110, by Messrs Technibond Ltd, The Valley Centre, High Wycombe, Bucks. Such foam has a Shore 00 hardness of 25, requires a force of 1.5 Newtons per square centimeter to compress it, exhibits a compression deflection of 0.5 Newtons per square centimeter and a compression set of 10% maximum.

The surround 30 is of rectangular section 4.5 millimeters thick and 6 millimeters broad and the surround 30' is of rectangular section 3 millimeters thick and 6 millimeters broad. The surround 30, because of its greater thickness, has a greater bending wave impedance than that of the surround 30' and is also capable of allowing a greater excursion of the diaphragm 10. The surrounds 30 and 30' are suitable for matching the bending wave impedance of a diaphragm 10 which has a thickness in the range 0.5 to 1 millimeters and is of the diameter and shape given above.

The re-entrant portion makes a circumferential line contact with the surround 30, 30' to which it adheres by virtue of the adhesive provided on the foam. As can be seen in FIG. 10, the foam material extends radially further outwardly of the line of contact than it does radially inwardly thereof.

The loudspeaker drive unit shown in FIG. 10 further includes a diaphragm-type suspension 40 for the voice coil 16, an aero-dynamically shaped magnet assembly 42, and a rear support tube 44.

In all of the above constructions, the bending wave impedance of the diaphragm is preferably made substantially equal to that of the surround by an appropriate choice of materials and dimensions. If, however, a less high quality loudspeaker drive unit is all that is required, it is possible to leave the bending wave impedances unmatched.

The invention is also applicable to loudspeaker drive units with dome-type diaphragms.

The first material of which the diaphragm is made may be chemically the same as the second material of which the surround is made but treated differently to modify its physical properties in order to provide stiffness for the diaphragm and flexibility for the surround. For example, the diaphragm may be of a non-foamed plastics material and the surround of the same plastics material in a foamed form.

What is claimed is:

1. A loudspeaker drive unit comprising:

a diaphragm made of a first material;

a chassis member; and a surround made of a second, different, material connecting the periphery of the diaphragm to the chassis member, the surround being made of a body of foam material arranged to be compressed against the chassis member when the diaphragm moves towards the chassis member; wherein:

the diaphragm is cone-shaped and has a first, narrow end and a second, broad end, the periphery of the broad end of said diaphragm is joined to the foam by a re-entrant portion, said re-entrant portion extending in a direction toward said narrow end;

the area over which the re-entrant portion makes contact with the body of foam material is substantially a line of contact between the circumference of the diaphragm and the foam material, said line of contact being defined by the re-entrant portion of said diaphragm making contact with said foam material at an angle.

2. A loudspeaker drive unit as claimed in claim 1, wherein the foam material extends radially further outwardly of the line of contact than it does radially inwardly thereof.

3. A loudspeaker as claimed in claim 1, wherein the foam material is a low density, very soft PVC foam material.

4. A loudspeaker drive unit as claimed in claim 1, wherein the diaphragm is made of a resin-impregnated woven plastics material.

5. A loudspeaker drive unit as claimed in claim 1, wherein the surround is of substantially rectangular cross-section and two opposite sides of the rectangle run substantially parallel to the longitudinal axis of the drive unit, and the two remaining sides are joined to the diaphragm and chassis member respectively.

6. A loudspeaker drive unit as claimed in claim 1, wherein substantially all parts of the surround member located between the diaphragm and the chassis member and capable of radiating sound are arranged parallel or at an acute angle with respect to the longitudinal axis of the loudspeaker drive unit.

7. A loudspeaker drive unit as claimed in claim 1, wherein the outer portion of the diaphragm lies axially beyond the chassis member.

8. A loudspeaker drive unit comprising:

a chassis member;

a magnet system mounted on said chassis member;

a cone-shaped diaphragm made of a resin-impregnated woven plastics material, said diaphragm having a first, narrow end and a second, broad end;

a voice coil located on said narrow end of said cone-shaped diaphragm and located in the magnetic field of said magnet system;

a surround member made of a body of low density foam material located on said chassis member; and a peripheral return portion of said diaphragm directed backwardly generally towards said narrow end and joining said broad end of said diaphragm to the body of foam material and making contact with the body of foam material over a narrow line-like path defined by an angled meeting of the peripheral return portion of said diaphragm with said foam material;

said peripheral return portion and said surround member connecting the broad end of said cone-shaped diaphragm to the chassis member so that said foam material is compressed against the chassis member when the diaphragm moves towards the chassis member.

9. A loudspeaker drive unit as claimed in claim 8, wherein the return portion is an integrally-formed part of the diaphragm.

10. A loudspeaker drive unit as claimed in claim 8, wherein the plastics material is a polyaramide plastics material.

11. A loudspeaker drive unit as claimed in claim 8, wherein the surround member is of oblong cross-section.

12. A loudspeaker drive unit as claimed in claim 8, wherein substantially all parts of the surround member located between the diaphragm and the chassis member and capable of radiating sound are arranged parallel or at an acute angle with respect to the longitudinal axis of the loudspeaker drive unit.

13. A loudspeaker drive unit as claimed in claim 1, wherein the outer portion of the diaphragm lies axially beyond the chassis member.

14. A loudspeaker drive unit comprising;

a chassis member;

a magnet system mounted on said chassis member;

a diaphragm;

a voice coil located on said diaphragm and located in the magnetic field of said magnet system; and a surround member made of a body of low density foam material located on said chassis member;

said surround member connecting the outside of said diaphragm to the chassis member so that said foam material is compressed against the chassis member when the diaphragm moves towards the chassis member and said foam material providing a terminating impedance so matched to the bending wave impedance of the diaphragm as to prevent bending waves traveling in the diaphragm from being reflected back into said diaphragm by said foam material.

15. A loudspeaker drive unit as claimed in claim 14, wherein said diaphragm is cone-shaped and a peripheral return portion of said cone joins the outer end of said cone to the body of foam material and makes contact with the body of foam material over a narrow line-like path.

16. A loudspeaker drive unit as claimed in claim 14, wherein the foam material has a Shore hardness in the range 20 to 30.

17. A loudspeaker drive unit as claimed in claim 14, wherein the surround member is of square cross-section.

18. A loudspeaker drive unit as claimed in claim 14, wherein substantially all parts of the surround member located between the diaphragm and the chassis member and capable of radiating sound are arranged parallel or at an acute angle with respect to the longitudinal axis of the loudspeaker drive unit.

19. A loudspeaker drive unit as claimed in claim 14, wherein the surround member is made of foam plastics material.

20. A loudspeaker drive unit as claimed in claim 14, wherein the diaphragm is made of a resin-impregnated woven plastics material.

21. A loudspeaker drive unit as claimed in claim 14, wherein the outside of said diaphragm contacts said surround member at an angle to define a line of contact therewith.

22. A loudspeaker drive unit as claimed in claim 14, wherein said diaphragm has first and second ends, said outside is at the second end of said diaphragm, and said outside of said diaphragm comprises a portion directed generally backwards towards said first end of said diaphragm.

* * * * *